US005954596A

United States Patent [19]

Noble et al.

[11] Patent Number: 5,954,596

[45] Date of Patent: Sep. 21, 1999

[54] GOLF CLUB HEAD WITH REINFORCED FRONT WALL

[75] Inventors: Randall B. Noble; Daniel J. Kubica, both of Phoenix, Ariz.

[73] Assignee: Karsten Manufacturing Corporation, Phoenix, Ariz.

[21] Appl. No.: 08/984,762

[22] Filed: Dec. 4, 1997

[51] Int. Cl.[6] ..... A63B 53/04

[52] U.S. Cl. ..... 473/346; 473/350

[58] Field of Search ..... 473/329, 330, 473/332, 341, 342, 343, 345, 346, 349, 350

[56] References Cited

U.S. PATENT DOCUMENTS

| | | | |
|---|---|---|---|
| 1,485,685 | 3/1924 | McMahon | 473/345 |
| 2,460,435 | 2/1949 | Schaffer | 473/346 |
| 2,809,838 | 10/1957 | Oquist | 473/345 |
| 4,511,145 | 4/1985 | Schmidt . | |
| 4,957,294 | 9/1990 | Long | 473/350 |
| 5,028,049 | 7/1991 | McKeighen . | |
| 5,141,230 | 8/1992 | Antonious | 473/345 |
| 5,163,682 | 11/1992 | Schmidt . | |
| 5,261,663 | 11/1993 | Anderson . | |
| 5,586,948 | 12/1996 | Mick | 473/346 |
| 5,766,094 | 6/1998 | Mahaffey et al. | 473/345 |
| 5,776,011 | 7/1998 | Su et al. | 473/350 |

*Primary Examiner*—Steven Wong
*Attorney, Agent, or Firm*—Darrell F. Marquette

[57] ABSTRACT

A golf club head having a heel end and toe end includes a hollow body with a top wall, a bottom wall, a side wall connecting the top and bottom walls and a front wall arranged for impacting a golf ball. The front wall of the body varies in thickness in two planes including a first plane that is disposed substantially horizontally between the top and bottom walls of the body and a second plane that is disposed substantially vertically between the heel and toe ends of the head. The body front wall has increased thickness along an axis where the two planes intersect. The increased thickness of the front wall decreases in four directions including a first direction extending from this axis toward the body top wall, a second direction extending from this axis toward the body bottom wall, a third direction extending from this axis toward the head heel end, and a fourth direction extending from this axis toward the head toe end.

4 Claims, 5 Drawing Sheets

GOLF CLUB HEAD WITH REINFORCED FRONT WALL

BACKGROUND OF THE INVENTION

This invention relates generally to golf clubs and, in particular, to a golf club commonly referred to as a "driver".

Recent developments in golf club design have included improvements in "drivers" which are used primarily to strike a golf ball resting on a golf tee. These improvements have resulted in drivers with club heads consisting of a hollow shell usually made of metal such as steel, aluminum or titanium. These hollow shells have relatively thin walls including a thin front wall which is used to impact a golf ball. In order to prevent the front wall of these hollow shells from permanently deforming upon ball impact, it has become necessary to reinforce them. One example of a golf club head consisting of a hollow metal shell with a reinforced front wall is disclosed in U.S. Pat. No. 4,511,145 to G. Schmidt. The club head disclosed in the Schmidt patent has an arched ridge extending between heel and toe ends of the front wall. Another example of a golf club head with a reinforced front wall in a hollow metal shell is disclosed in U.S. Pat. No. 5,028,049 to J. McKeighen. In the McKeighen club head, the front wall of the hollow shell has an increased overall thickness but it is thinnest at its geometrical center.

SUMMARY OF THE INVENTION

The present invention provides a golf club head having a heel end and a toe end wherein the golf club head is comprised of a hollow body having a top wall, a bottom wall, a side wall connecting the top and bottom walls and a front wall arranged for impacting a golf ball. The body front wall varies in thickness in a first plane disposed substantially horizontally between the top and bottom walls of the body and in a second plane disposed substantially vertically between the heel and toe ends of the head. The front wall has increased thickness along an axis where the first and second planes intersect. The increased thickness of the front wall gradually decreases in a first direction extending from this axis toward the body top wall, in a second direction extending from this axis toward the body bottom wall, in a third direction extending from this axis toward the head heel end, and in a fourth direction extending from this axis toward the head toe end.

The front wall has a geometric center and the axis of intersection of the first and second planes extends through this geometric center so that the increased thickness of the front wall is greatest at the geometric center. In the preferred embodiment of the club head, the front wall has a first thickness dimension at its geometric center, and a second thickness dimension adjacent the heel and toe ends of the head. The first thickness dimension is greater than the second thickness dimension. The front wall also has a third thickness dimension adjacent the top and bottom walls of the body. The first thickness dimension is greater than the third thickness dimension. The second and third thickness dimensions may be equal.

DESCRIPTION OF THE PREFERRED EMBODIMENT

Figure 1:
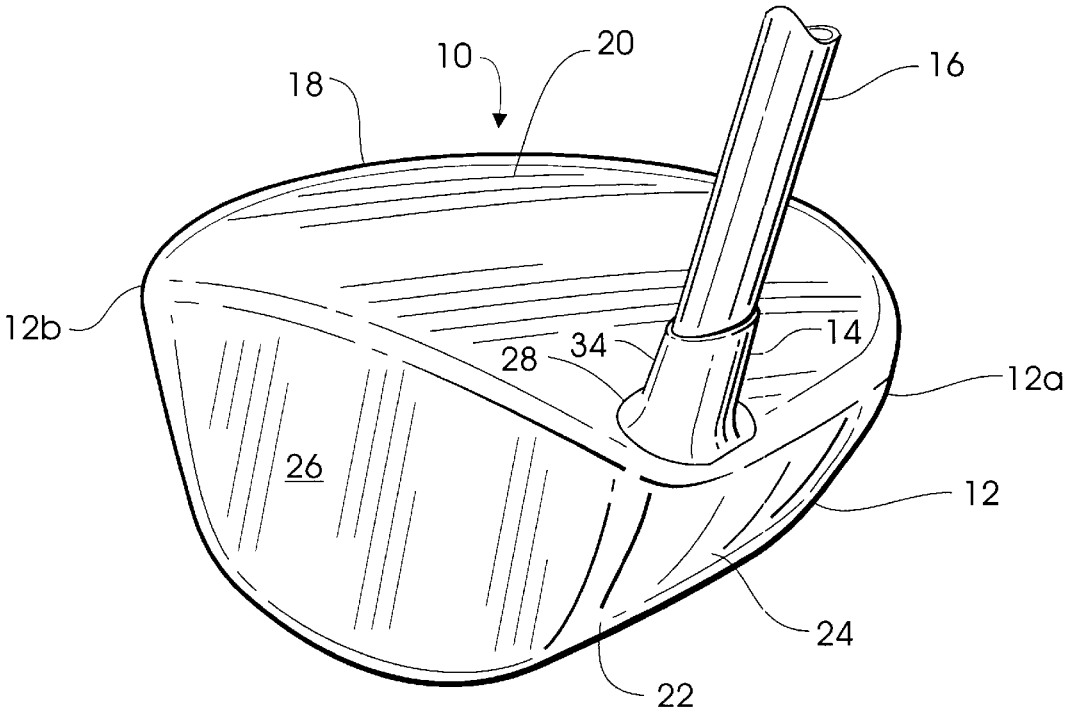
FIG. 1 is a perspective view of a golf club, partially broken away, embodying the preferred embodiment of the present invention.
Figure 1A:
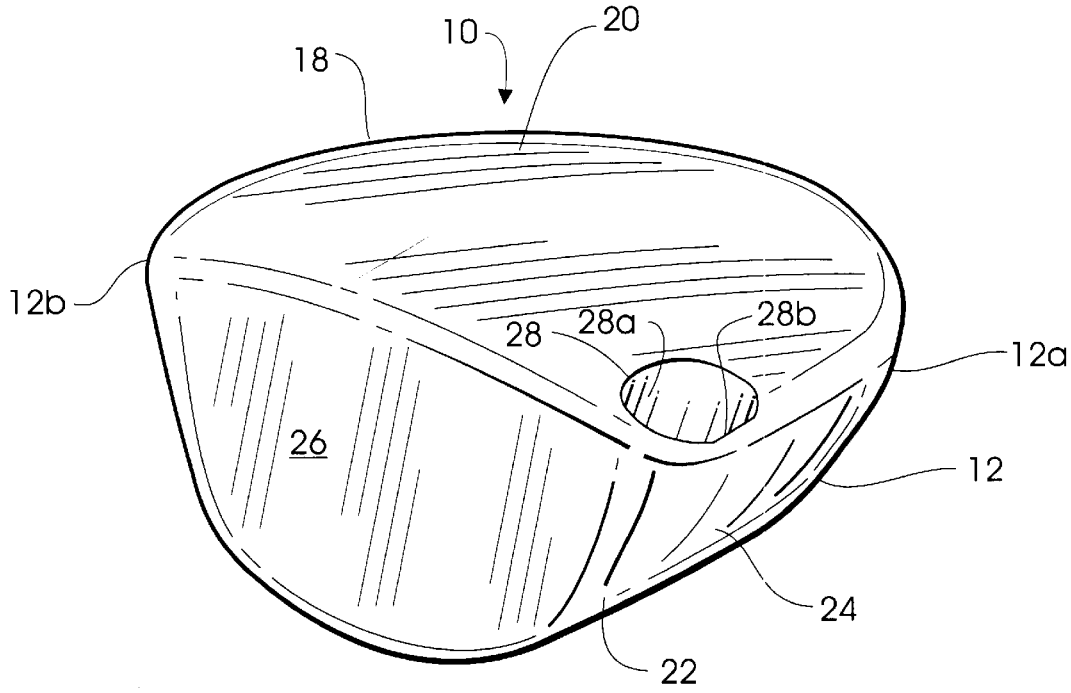
FIG. 1*a* is a perspective view of one part of the golf club shown in FIG. 1.
Figure 1B:
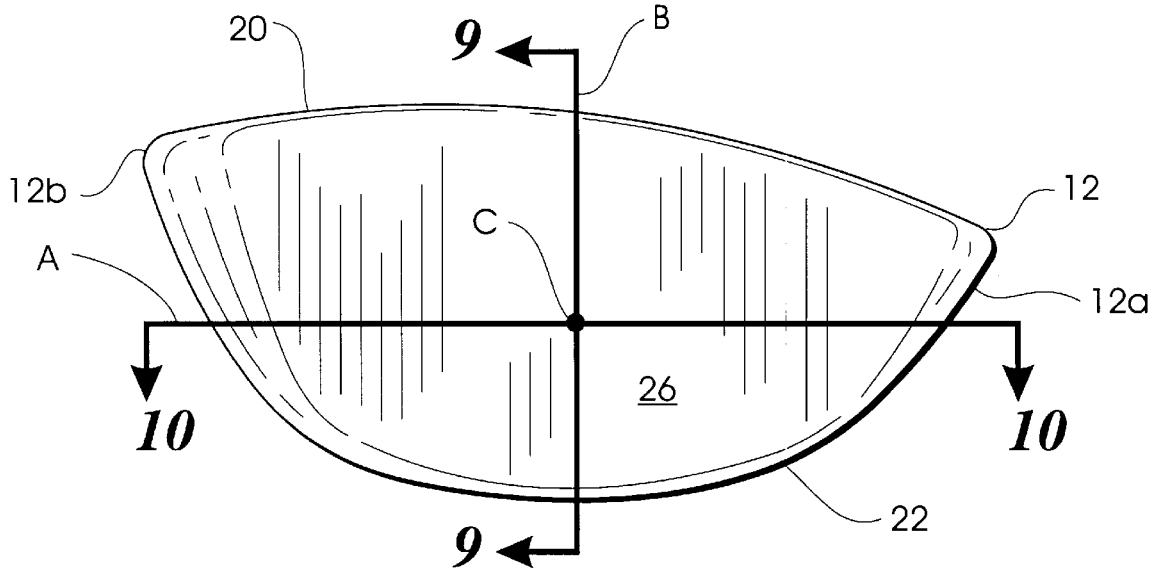
FIG. 1*b* is a front elevational view of the part shown in FIG. 1*a;*
Figure 2:
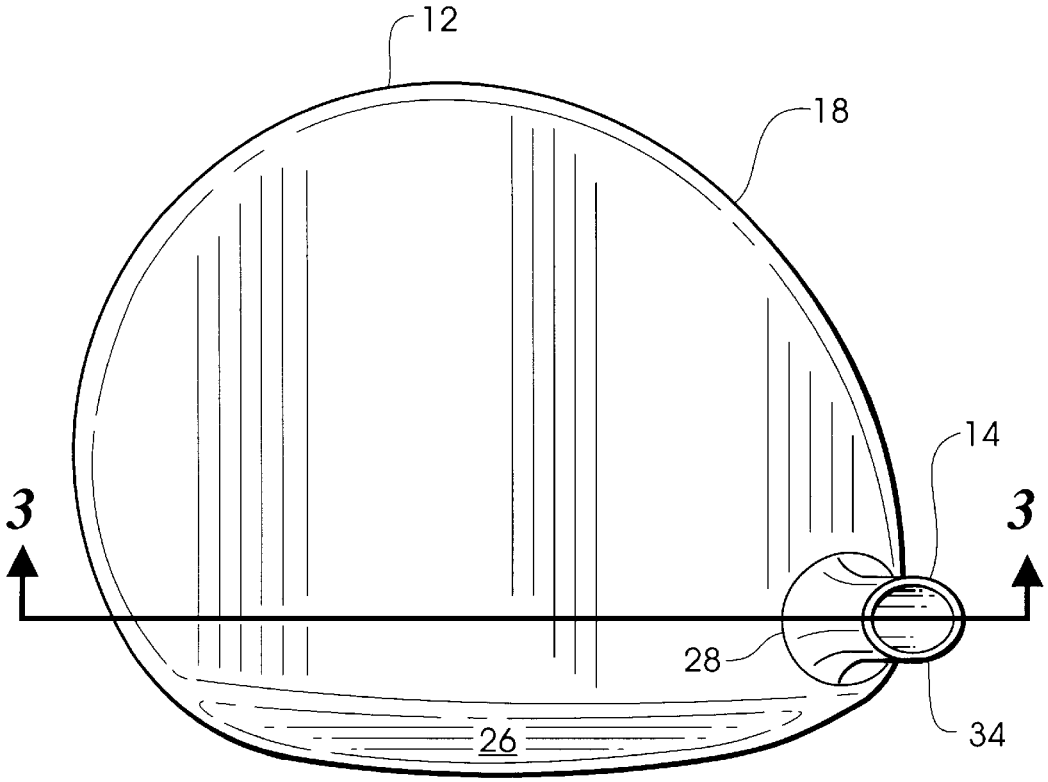
FIG. 2 is a top plan view of the golf club shown in FIG. 1.

Referring to FIG. 1, a golf club 10 incorporating the present invention includes a head 12, a hosel 14 and a shaft 16. Head 12 is comprised of a hollow body 18 made of a first material such as titanium having a high shear modulus of elasticity. The hollow body 18 has a top wall 20, a bottom wall 22, a side wall 24 connecting the top and side walls 20 and 22, and a front wall 26 arranged for impacting a golf ball. Further, the head 12 has a heel end 12*a* and a toe end 12*b*.

Figure 3:
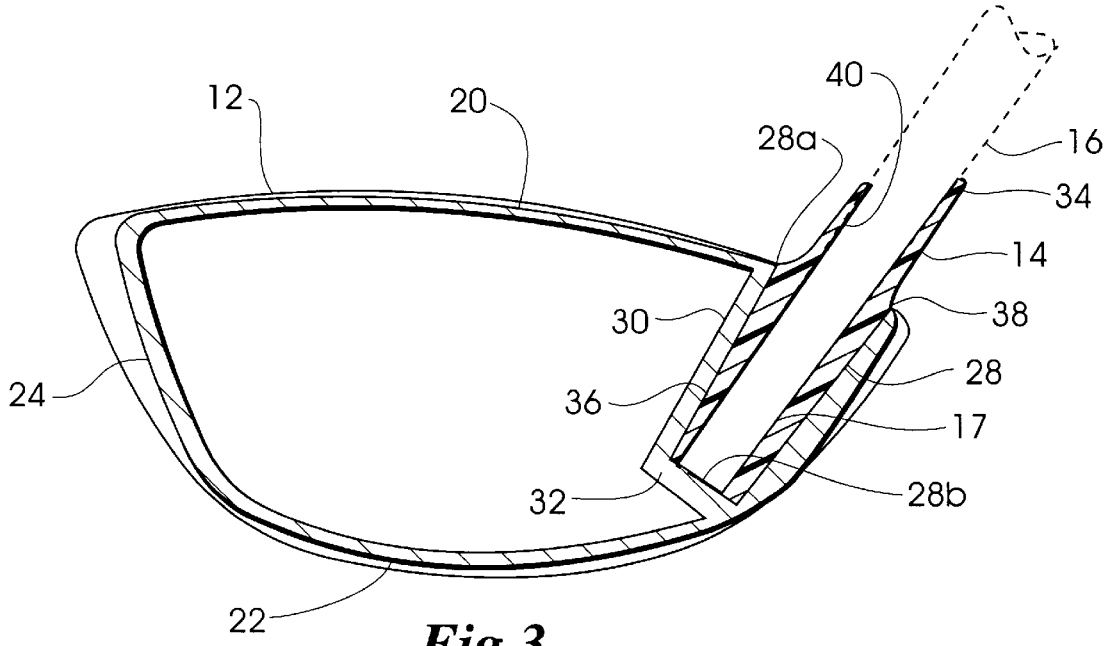
FIG. 3 is a sectional view taken along lines 3—3 in FIG. 2.
Figure 4:
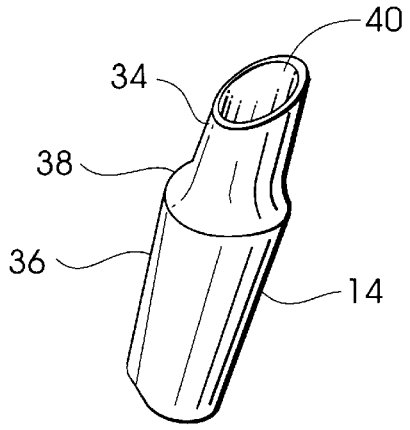
FIG. 4 is a perspective view of another part used in the golf club shown in FIGS. 1–3.
Figure 5:
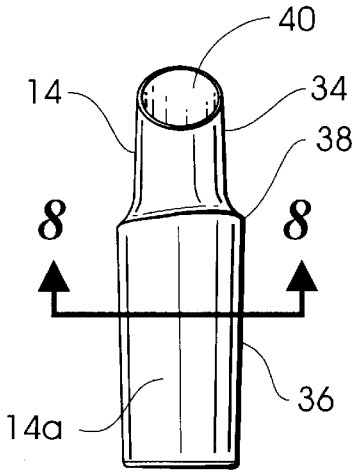
FIG. 5 is a front elevational view of the part shown in FIG. 4.
Figure 6:
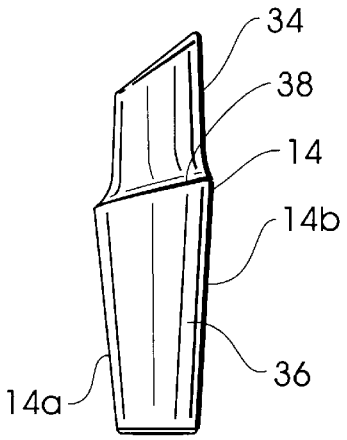
FIG. 6 is a side elevational view of the part shown in FIG. 4.
Figure 7:
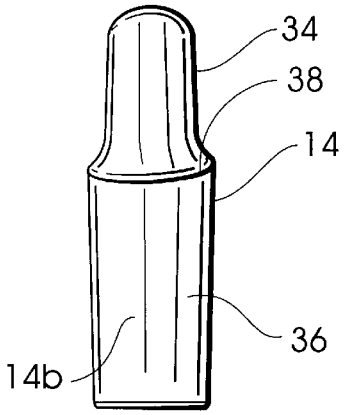
FIG. 7 is a rear elevational view of the part shown in FIG. 4.
Figure 8:
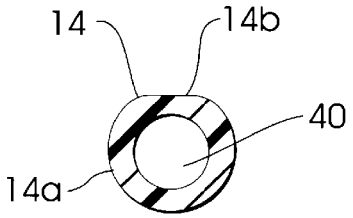
FIG. 8 is a sectional view taken along lines 8—8 in FIG. 5.

A bore 28 is provided in the heel end 12*a* of the head 12 extending downwardly from the body top wall 20 toward the body bottom wall 22. The bore 28 has a top end 28*a* which is open and a bottom 28*b* which is closed. As seen in FIG. 3, the top end 28*a* of the bore 28 is substantially flush with the top wall 20 of the body 18, and the bore bottom end 28*b* is spaced from the bottom wall 22 of the body 18. The bore 28 is defined by a lateral wall 30 connected with the side wall 24 of the body 18, and an end wall 32 connected with the lateral wall 30.

The hosel 14 is formed of a second material such as plastic having a low shear modulus of elasticity. Hosel 14 includes an upper portion 34 that extends upwardly from the top wall 20 of the body 18 and a lower portion 36 that is inserted into the bore 28. The upper and lower hosel portions 34, 36 are separated by a parting line 38. The hosel 14 also has a substantially longitudinal passage 40 extending through its upper and lower portions 34, 36. When the golf club 10 is assembled as shown in FIG. 3, the hosel 14 contacts the bottom end 32 of the bore 28.

The shaft 16 is made of a third material, preferably graphite, having a low shear modulus of elasticity. Shaft 16 has a tip end 17 received in the hosel passage 40. The shaft tip end 17 extends completely through the hosel 14 and contacts the bottom end 32 of the bore 28. In the preferred embodiment of the golf club 10, the shear modulus of elasticity of the hosel 14 is much closer to the shear elastic modulus of the shaft 16 than to the shear elastic modulus of the head 12. This relationship of elastic moduli causes the hosel 14 to absorb much of the shock resulting from the head 12 striking a golf ball on the front face 26. Therefore, less shock is transmitted to the shaft 16 which prevents breakage of the shaft 16 and permits the shaft 16 to have a weaker tip end 17 which reduces cost.

Referring to FIGS. 4–8, it is seen that the lower portion 36 of the hosel 14 has an irregular outside shape defined by a generally arcuate surface 14*a* covering its front and sides, and a generally flat surface 14*b* covering its back. The bore 28 in the head 12 has a complementary irregular inside shape defined by a generally arcuate surface 28*a* and a generally flat surface 28*b*. Therefore, the hosel 14 may be inserted into the bore 28 in only one orientation which ensures exact alignment of the shaft 16 relative to the head 12. In that orientation, the generally arcuate surfaces 14*a*, 28*a* of the hosel 14 and the bore 28 mate with each other, and the generally flat surfaces 14*b*, 28*b* of the hosel 14 and the bore 28 also mate with each other.

Since the hosel 14 is made of softer material than the head 12, the hosel 14 has a cushioning effect on the shaft 16. This cushioning effect significantly reduces the amount of vibration that is transmitted to the shaft 16 which increases shaft life.

Figure 9:
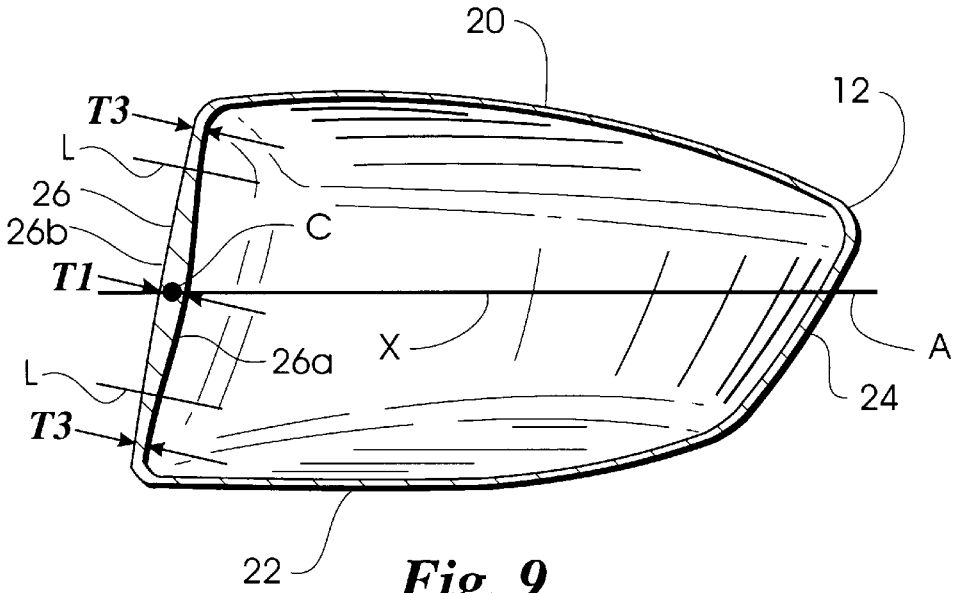
FIG. 9 is a sectional view taken along lines 9—9 in FIG. 1*b*.
Figure 10:
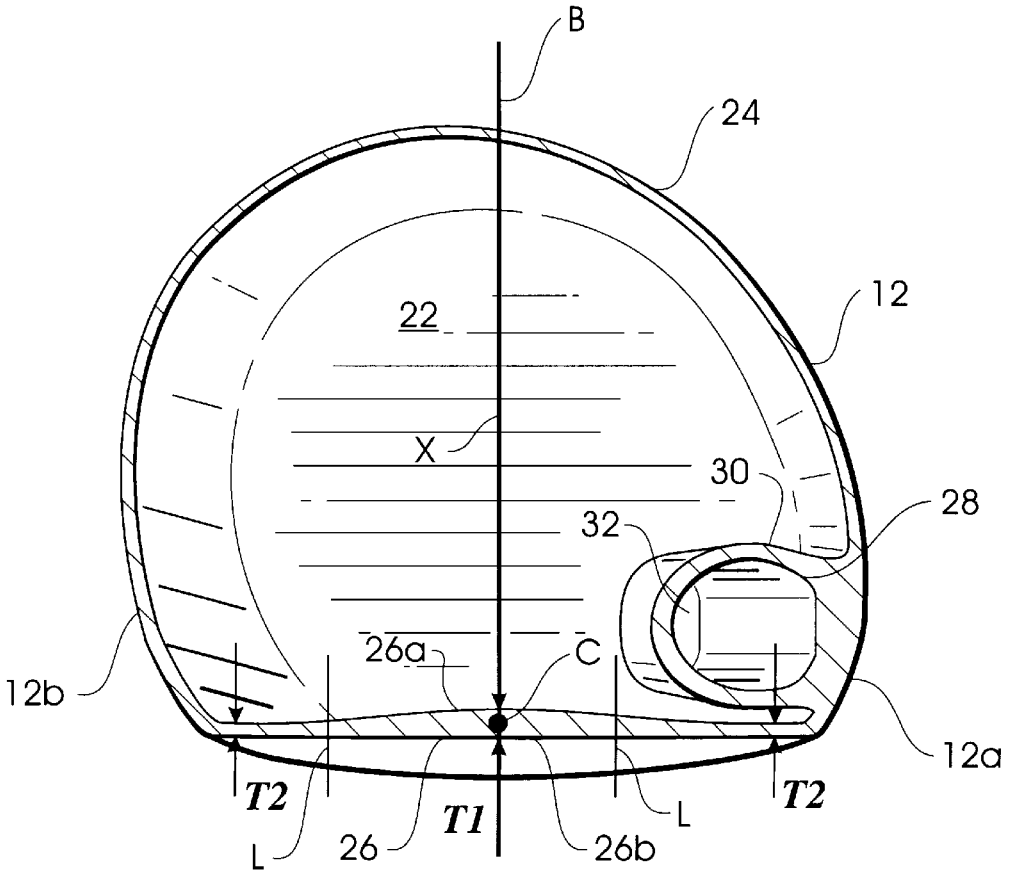
FIG. 10 is a sectional view taken along lines 10—10 in FIG. 1*b*.

Referring to FIGS. 9-10, it will be understood that the front wall 26 of the body 18 has a thickness between its inner and outer surfaces 26*a*, 26*b* when measured along lines L (which are perpendicular thereto) and is reinforced by providing it with increased thickness near its geometric center C. The front wall 26 varies in thickness in a first plane A that is disposed substantially horizontally between the top and bottom walls 20, 22 of the body 18. The front wall 26 also varies in thickness in a second plane B that is disposed substantially vertically between the head heel and toe ends 12*a*, 12*b*.

As seen in FIGS. 9 and 10, the front wall 26 has a bulging area of increased thickness on its surface 26*a* surrounding an axis X where the planes A and B intersect. Since this axis X extends through the geometric center C of the front wall 26, the increased thickness of the front wall 26 is greatest at the geometric center C. The front wall increased thickness gradually decreases in a first direction extending from the axis X to the top wall 20, in a second direction extending from the axis X to the bottom wall 22, in a third direction extending from the axis X to the heel end 12*a*, and in a fourth direction extending from the axis X to the toe end 12*b*.

The head front wall 26 has a first thickness dimension T1 at its geometric center C, a second thickness dimension T2 adjacent the heel and toe ends 12*a*, 12*b*, and a third thickness dimension T3 adjacent the top and bottom walls 20, 22. The thickness dimension T1 is greater than the thickness dimensions T2 and T3; and the thickness dimensions T2 and T3 may be equal. In the preferred embodiment, the thickness dimension T1 is between 0.130 and 0.180 inch, the thickness dimension T2 is between 0.040 and 0.125 inch, and the thickness dimension T3 is between 0.040 and 0.125 inch.

By reinforcing the front wall 26 with the increased thickness T1 as described above, front wall 26 is strengthened at its geometric center C where loading is the greatest when impacting a golf ball. Also, by providing the front wall 26 with the decreased thickness dimensions T2 and T3, mass is redistributed to other parts of the head 12 to enhance performance of the golf club 10.

What is claimed is:

1. A golf club head comprising:

a hollow body having a top wall, a bottom wall, a side wall connecting said top and bottom walls and a front wall arranged for impacting a golf ball, said front wall having an inner surface and an outer surface, said front wall also having a geometric center and a thickness measured between said inner and outer surfaces along lines perpendicular thereto;

a heel end and a toe end;

said front wall thickness varying in a first plane disposed substantially horizontally between said top and bottom walls and in a second plane disposed substantially vertically between said heel and toe ends;

said front wall having a bulging area of increased thickness formed on said inner surface surrounding an axis extending through said geometric center where said first and second planes intersect for reinforcing said front wall, the bulging area of increased thickness of said front wall being greatest at said geometric center and gradually decreasing in a first direction extending from said axis toward said top wall, in a second direction extending from said axis toward said bottom wall, in a third direction extending from said axis toward said heel end, and in a fourth direction extending from said axis toward said toe end, said bulging area of increased thickness causing said inner surface of said front wall to be nonplanar;

said front wall having a first thickness dimension at said geometric center and a second thickness dimension adjacent said heel and toe ends, said first thickness dimension being greater than said second thickness dimension; and said front wall having a third thickness dimension adjacent said top and bottom walls, said first thickness dimension being greater than said third thickness dimension.

2. The golf club head of claim 1, wherein said second and third thickness dimensions are equal.

3. The golf club head of claim 1, wherein said first thickness dimension is between 0.130 and 0.180 inch.

4. The golf club head of claim 1, wherein said second and third thickness dimensions are between 0.040 and 0.125 inch.

* * * * *